US007402942B2

(12) United States Patent
Lee et al.

(10) Patent No.: US 7,402,942 B2
(45) Date of Patent: Jul. 22, 2008

(54) ELECTRON EMISSION DEVICE AND ELECTRON EMISSION DISPLAY USING THE SAME

(75) Inventors: Seung-Hyun Lee, Yongin-si (KR); Seong-Yeon Hwang, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 0 days.

(21) Appl. No.: 11/588,349

(22) Filed: Oct. 27, 2006

(65) Prior Publication Data

US 2008/0018225 A1 Jan. 24, 2008

(30) Foreign Application Priority Data

Oct. 31, 2005 (KR) ..... 10-2005-0103355
Oct. 10, 2006 (KR) ..... 10-2006-0098525

(51) Int. Cl.
*H01J 29/46* (2006.01)

(52) U.S. Cl. ..... 313/422; 313/497

(58) Field of Classification Search ..... 313/497, 313/309–311, 336, 357, 422; 315/169.1, 315/169.3

See application file for complete search history.

(56) References Cited

U.S. PATENT DOCUMENTS 6,225,761 B1 5/2001 Dworsky et al.
7,102,278 B2 * 9/2006 Oh et al. ..... 313/495
2001/0028215 A1 10/2001 Kim
2002/0193036 A1 12/2002 Benning et al.
2004/0232823 A1 11/2004 Nakata et al.
2005/0184647 A1 * 8/2005 Chang ..... 313/497
2005/0189865 A1 * 9/2005 Lee ..... 313/495
2005/0242704 A1 * 11/2005 Lee et al. ..... 313/495
2006/0055311 A1 * 3/2006 Jung et al. ..... 313/496

FOREIGN PATENT DOCUMENTS

WO WO 00/24027 4/2000

OTHER PUBLICATIONS

Search Report issued on Jul. 6, 2007 by the European Patent Office for European Patent Application No. 06123133.8-2208.

* cited by examiner

*Primary Examiner*—Nimeshkumar Patel
*Assistant Examiner*—Christopher M Raabe
(74) *Attorney, Agent, or Firm*—Stein, McEwen & Bui, LLP

(57) ABSTRACT

An electron emission device, and an electron emission display using the electron emission device, includes a substrate, electron emission regions formed on the substrate, driving electrodes formed on the substrate to control electron emissions of the electron emission regions, and a focusing electrode disposed above the driving electrodes and insulated from the driving electrodes, the focusing electrode having openings through which electron beams pass. The focusing electrode includes at least two focusing parts electrically separated from each other and the focusing parts focus the electron beams in different directions.

35 Claims, 10 Drawing Sheets

ELECTRON EMISSION DEVICE AND ELECTRON EMISSION DISPLAY USING THE SAME

CROSS-REFERENCE TO RELATED APPLICATIONS

This application claims the benefit of Korean Patent Application No. 2005-103355, filed Oct. 31, 2005 in the Korean Intellectual Property Office; and Korean Patent Application No. 2006-98525, filed Oct. 10, 2006 in the Korean Intellectual Property Office, the disclosures of which are incorporated herein by reference in their entireties.

BACKGROUND OF THE INVENTION

1. Field of the Invention

Aspects of the present invention relate to an electron emission device, and more particularly, to an electron emission device having a focusing electrode that is improved to enhance the focusing efficiency of an electron beam, and an electron emission display using the electron emission device.

2. Description of the Related Art

Generally, electron emission elements are classified into those using a hot cathode as an electron emission source, and those using a cold cathode as the electron emission source. There are several types of cold cathode electron emission elements, including Field Emitter Array (FEA) elements, Surface Conduction Emitter (SCE) elements, Metal-Insulator-Metal (MIM) elements, and Metal-Insulator-Semiconductor (MIS) elements.

The FEA element includes an electron emission region and cathode and gate electrodes that are driving electrodes for controlling the electron emission from the electron emission region. The electron emission regions are formed of a material having a relatively low work function or a relatively large aspect ratio, such as a carbon-based material or a nanometer-sized material so that electrons can be effectively emitted when an electric field is applied thereto under a vacuum atmosphere.

The electron emission elements are arrayed on a first substrate to form an electron emission device. To form an electron emission display, the electron emission device is combined with a second substrate, on which a light emission unit having phosphor layers and an anode electrode is formed.

In the electron emission display, there has been an endeavor to improve the display quality by inducing an electron beam path in a target direction. For example, when the electrons emitted from the electron emission region are diffused and travel toward the second substrate, they land on a black layer adjacent to a target phosphor layer of a corresponding pixel and other phosphor layers as well as on the target phosphor layer, thereby emitting undesired color light. Therefore, a focusing electrode for controlling the electron beam has been proposed. The focusing electrode is generally disposed on an uppermost layer of the electron emission device and provided with openings through which respective electron beams pass. The electrons passing through each opening are converged toward a central axis of the electron beam.

However, since the focusing electrode is formed in a single body and the electron beams are converged by a single focusing voltage, it is difficult to precisely control a shape of an electron beam spot. That is, it is impossible to control the shape of the electron beam spot reaching each phosphor layer in horizontal and vertical directions of a screen and the electron beam convergent efficiency is low.

SUMMARY OF THE INVENTION

Aspects of the present invention provide an electron emission device that can independently control a vertical electron beam focusing and a horizontal electron beam focusing to improve the electron beam focusing efficiency and the display quality, and an electron emission display using the electron emission device.

According to an aspect of the present invention, there is provided an electron emission device including: a substrate; a plurality of electron emission regions formed on the substrate; a plurality of driving electrodes formed on the substrate to control electron emissions of the electron emission regions; and a focusing electrode disposed above the driving electrodes and insulated from the driving electrodes, the focusing electrode having openings through which electron beams pass, wherein the focusing electrode includes at least two focusing parts electrically separated from each other and the focusing parts focus the electron beams in different directions.

According to an aspect of the invention, the focusing parts may include first focusing parts arranged in a direction of the first substrate and provided with the openings and second focusing parts disposed between the first focusing parts and spaced apart from the first focusing parts.

According to an aspect of the invention, a longitudinal distance of each of the openings may be formed along a width of the first focusing part.

According to an aspect of the invention, the focusing parts may be different in a thickness from each other.

According to an aspect of the invention, the thickness of the second focusing part may be greater than that of the first focusing part.

According to an aspect of the invention, the focusing parts may be at different heights from each other above the driving electrode.

According to an aspect of the invention, indented portions may be formed on both sides of each first focusing part between the openings and protruding portions may be formed on both sides of each second focusing part, the protruding portions being formed to correspond to the respective indented portions such that the protruding portions are disposed in the indented portions.

According to an aspect of the invention, the driving electrodes may include cathode electrodes and gate electrodes crossing each other and disposed at different layers with an insulation layer interposed between the layers and the electron emission regions may be formed on the cathode electrodes at each of the crossed regions of the cathode and gate electrodes.

According to an aspect of the invention, the electron emission regions may be arranged in a line along a length of one of the cathode and gate electrodes at each crossed region.

According to an aspect of the invention, the focusing electrode openings may correspond to the respective crossed regions to simultaneously expose the electron emission regions formed at each crossed region.

According to an aspect of the invention, the electron emission region may be formed of a material selected from the group consisting of carbon nanotubes, graphite, graphite nanofibers, diamonds, diamond-like carbon, fullerene ($C_{60}$), silicon nanowires, and a combination thereof.

According to another aspect of the present invention, there is provided an electron emission display, including: first and second substrates facing each other; a plurality of electron emission regions formed on the first substrate; a plurality of driving electrodes formed on the first substrate to control electron emissions of the electron emission regions; a focusing electrode disposed above the driving electrodes and insulated from the driving electrodes, the focusing electrode having openings through which electron beams pass; red, green and blue phosphor layers formed on the second substrate; and an anode electrode formed on the phosphor layers, wherein the focusing electrode includes at least two focusing parts electrically separated from each other and the focusing parts focus the electron beams in different directions.

According to an aspect of the invention, the openings of the focusing electrode may correspond to respective pixel regions of the first substrate and the phosphor layers may correspond to the respective pixel regions.

According to still another aspect of the present invention, there is provided an electron emission device, including: a substrate; a plurality of electron emission regions formed on the substrate; a plurality of driving electrodes formed on the substrate to control electron emissions of the electron emission regions; and a focusing electrode disposed above the driving electrodes and insulated from the driving electrodes, the focusing electrode having openings through which electron beams pass, wherein the focusing electrode includes at least two focusing parts electrically separated from each other and the focusing parts form respective electric fields for focusing electron beams, the electric fields being different from each other.

According to an aspect of the invention, the focusing parts may include first focusing parts arranged in a direction of the first substrate and provided with the openings and second focusing parts disposed between the first focusing parts and spaced apart from the first focusing parts.

According to an aspect of the invention, the first focusing parts may be electrically connected to each other to form a first common electric field and the second focusing parts may be electrically connected to each other to form a second common electric field.

According to an aspect of the invention, a longitudinal distance of each of the openings may be formed along a width of the first focusing part.

According to an aspect of the invention, the focusing parts may be different in a thickness from each other.

According to an aspect of the invention, a voltage applied to the first focusing parts may be less than that applied to the second focusing parts.

According to an aspect of the invention, indented portions may be formed on both sides of each first focusing part between the openings and protruding portions may be formed on both sides of each second focusing part, the protruding portions being formed to correspond to the respective indented portions such that the protruding portions are disposed in the indented portions.

According to an aspect of the invention, the driving electrodes may include cathode electrodes and gate electrodes crossing each other and disposed at different layers with an insulation layer interposed between the layers and the electron emission regions are formed on the cathode electrodes at each of the crossed regions of the cathode and gate electrodes.

According to an aspect of the invention, the electron emission regions may be arranged in a line along a length of one of the cathode and gate electrodes at each crossed region.

According to an aspect of the invention, the focusing electrode openings may correspond to the respective crossed regions to simultaneously expose the electron emission regions formed at each crossed region.

According to still yet another aspect of the present invention, there is provided an electron emission display, including: first and second substrates facing each other; a plurality of electron emission regions formed on the first substrate; a plurality of driving electrodes formed on the first substrate to control electron emissions of the electron emission regions; a focusing electrode disposed above the driving electrodes and insulated from the driving electrodes, the focusing electrode having openings through which electron beams pass; red, green and blue phosphor layers formed on the second substrate; and an anode electrode formed on the phosphor layers, wherein the focusing electrode includes at least two focusing parts electrically separated from each other and the focusing parts form respective electric fields for focusing electron beams, the electric fields being different from each other.

According to an aspect of the invention, the openings of the focusing electrode may correspond to respective pixel regions of the first substrate and the phosphor layers correspond to the respective pixel regions.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
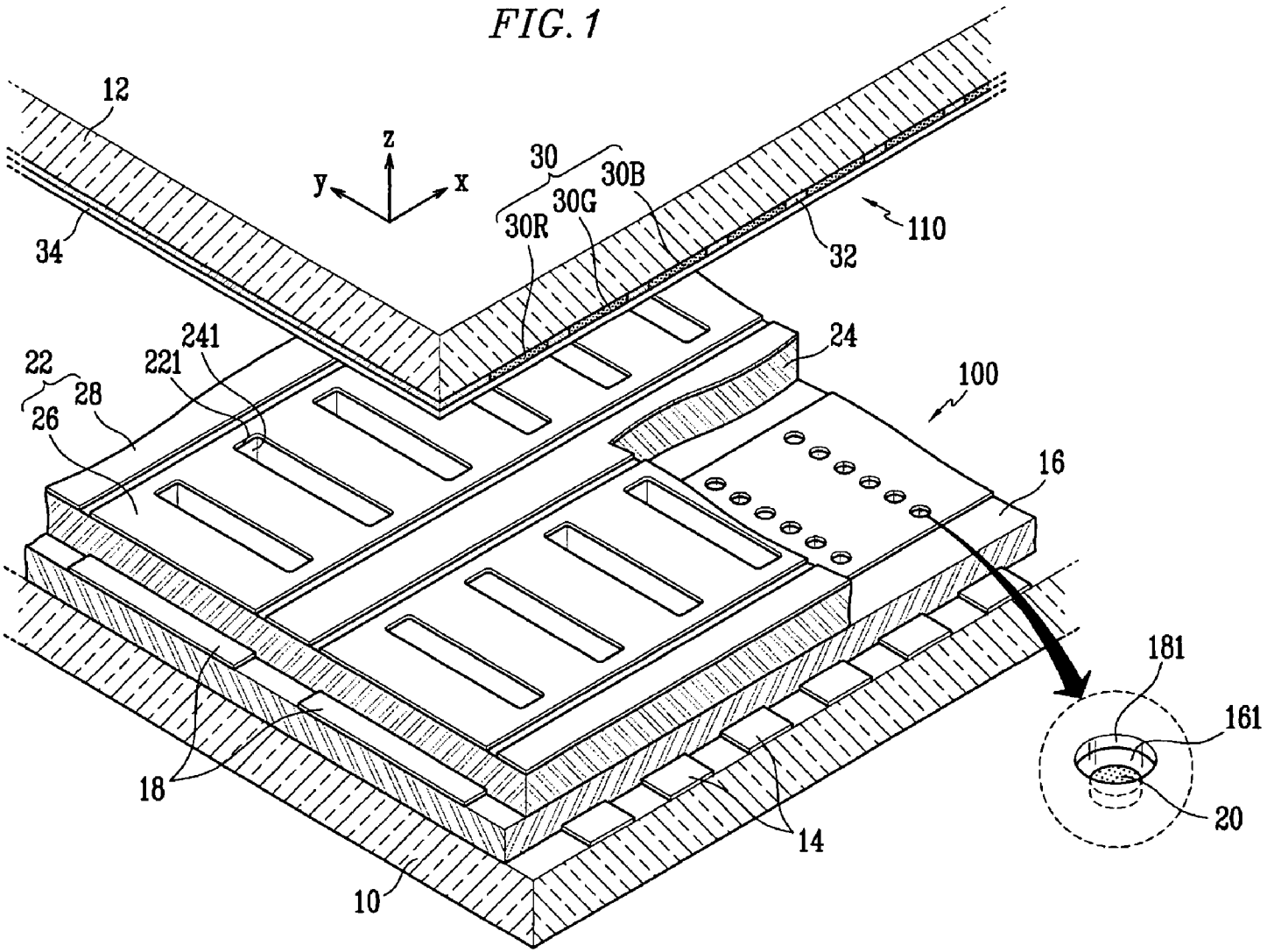
FIG. 1 is a partial exploded perspective view of an electron emission display according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
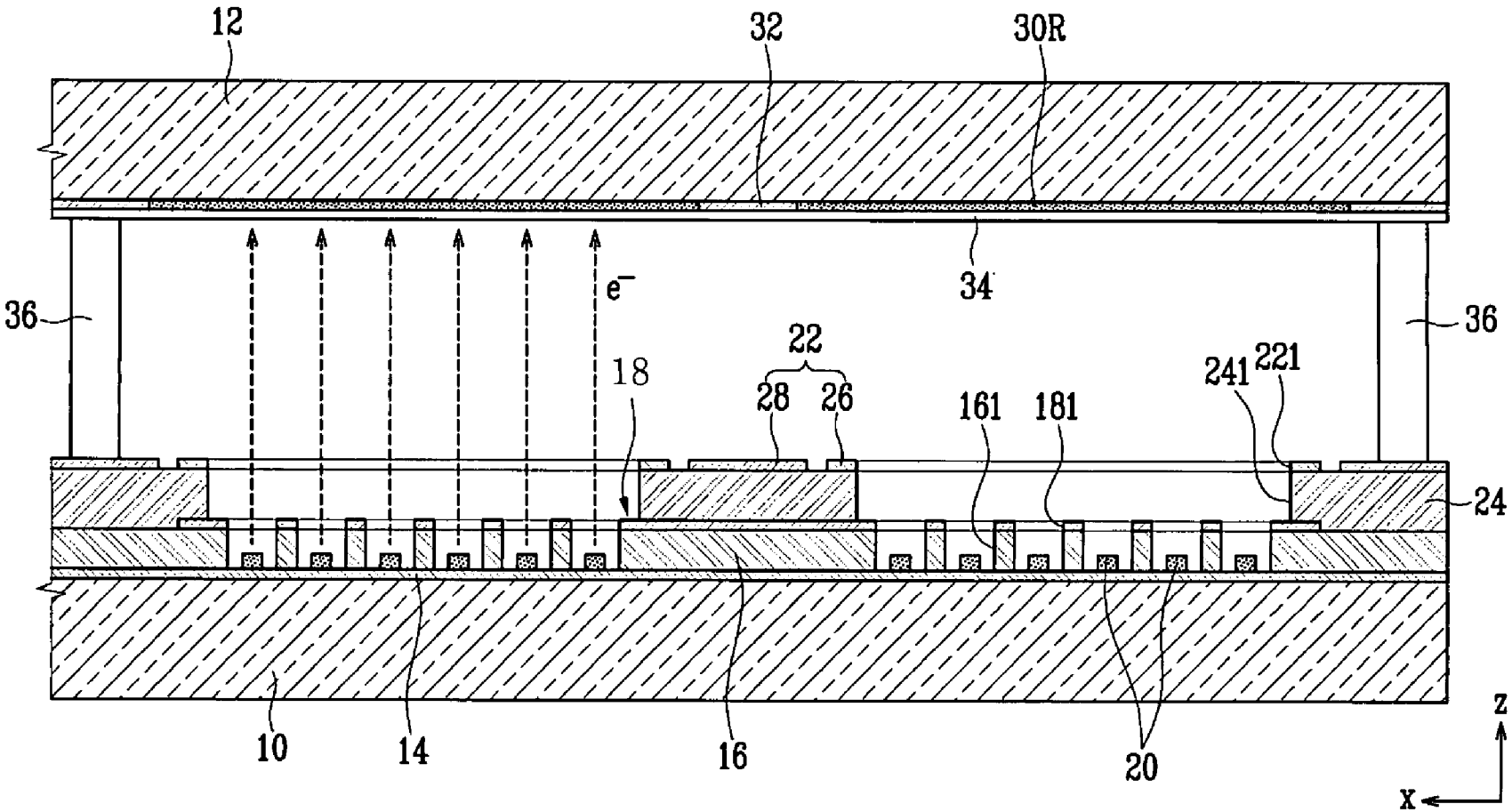
FIG. 2 is a partial sectional view of the electron emission display of FIG. 1.
Figure 3:
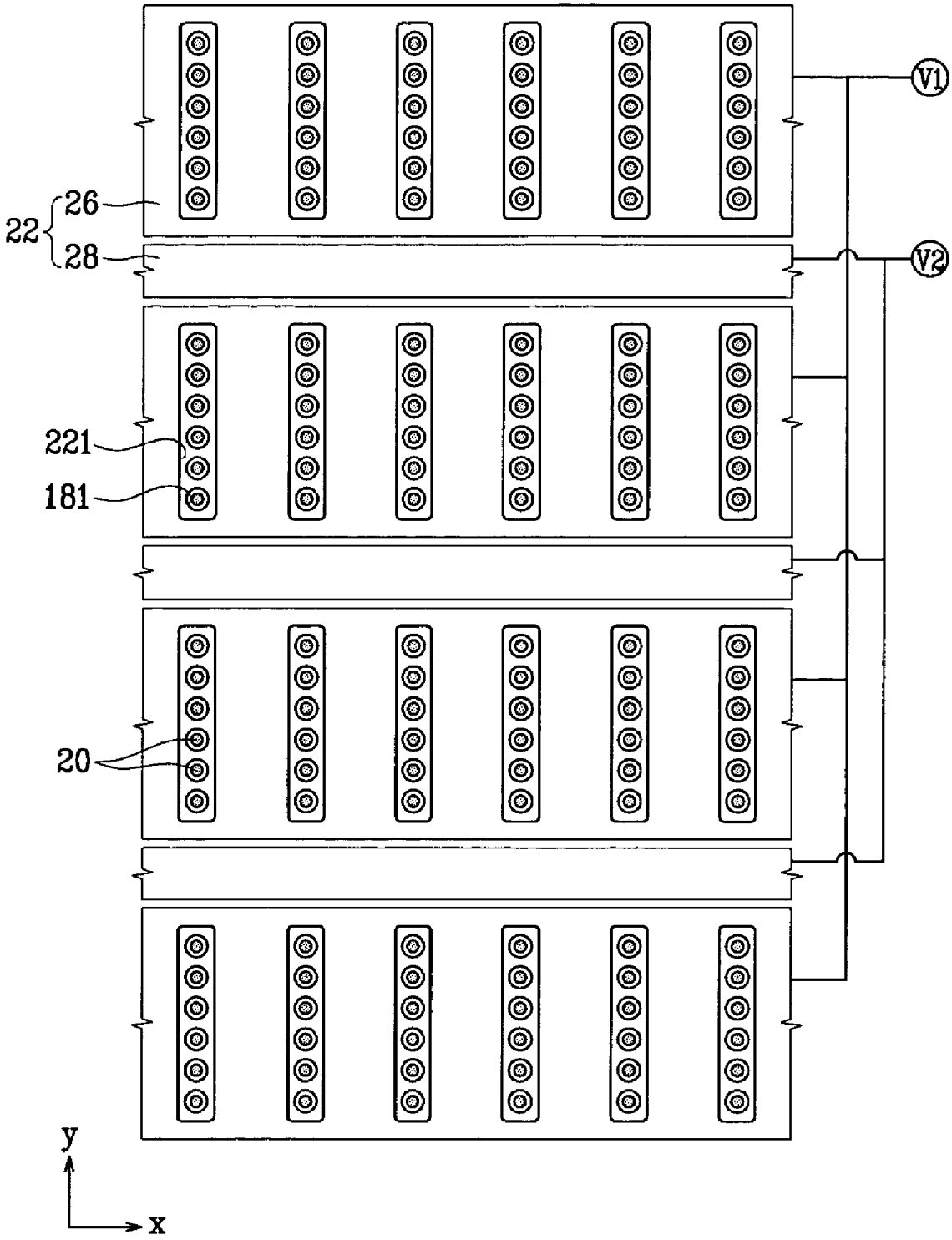
FIG. 3 is a partial top view of an electron emission device shown in FIG. 1.

FIG. 1 is a partial exploded perspective view of an electron emission display according to an embodiment of the present invention, FIG. 2 is a partial sectional view of the electron emission display of FIG. 1, and FIG. 3 is a partial top view of an electron emission device shown in FIG. 1. Referring to FIGS. 1 through 3, an electron emission display includes first and second substrates 10 and 12 facing each other and spaced apart at a predetermined interval. A sealing member (not shown) is provided at the peripheries of the first and second substrates 10 and 12 to seal the substrates 10, 12 together. The space defined by the first and second substrates 10, 12 and the sealing member is exhausted to form a vacuum envelope kept to a degree of vacuum of about $10^{-6}$ torr. However, it is understood that other degrees of vacuum can be used.

A plurality of electron emission elements is arrayed on a surface of the first substrate 10 facing the second substrate 12 to form an electron emission device 100. The electron emission device 100 is combined with a light emission unit 110 provided on the second substrate 12 to form the electron emission display.

A plurality of cathode electrodes (first electrodes) 14 is arranged on the first substrate 10 in a stripe pattern extending in a first direction (the y-axis of FIG. 1). A first insulation layer 16 is formed on the first substrate 10 to cover the cathode electrodes 14. A plurality of gate electrodes 18 (second electrodes) is formed on the first insulation layer 16 in a stripe pattern extending in a second direction crossing the first direction (the x-axis in FIG. 1) at a right angle.

Each crossed region of the cathode and gate electrodes 14 and 18 defines a pixel region. One or more electron emission regions 20 are formed on the cathode electrode 14 at each pixel region. Openings 161 and 181 corresponding to the respective electron emission regions 20 are formed in the first insulation layer 16 and the gate electrodes 18 respectively, to expose the electron emission regions 20 on the first substrate 10.

The electron emission regions 20 are formed of a material, which emits electrons when an electric field is applied thereto under a vacuum atmosphere. Examples include, but are not limited to, a carbonaceous material or a nanometer-sized material. For example, the electron emission regions 20 may be formed of carbon nanotubes, graphite, graphite nanofibers, diamonds, diamond-like carbon, fullerene ($C_{60}$), silicon nanowires, or a combination thereof. While not limited thereto, the electron emission regions 20 may be formed through a screen-printing, direct growth, sputtering, or chemical vapor deposition process. Alternatively, the electron emission regions 20 may be formed in a Mo-based or Si-based pointed-tip structure.

The electron emission regions 20 are arranged in a line along a length of one of the cathode and gate electrodes at each pixel region. As shown, the electron emission regions 20 are along the cathode electrode 14. Each of the electron emission regions 20 may have a circular top surface. The arrangement of the electron emission regions 20 at each pixel region and the shape of each electron emission region 20 are not limited to this shown embodiment.

In the foregoing description, although a case where the gate electrodes 18 are arranged above the cathode electrodes 14 with the first insulation layer 16 interposed therebetween is described, the present invention is not limited to such a case. That is, the gate electrodes 18 may be disposed under the cathode electrodes 14 with the first insulation layer 16 interposed therebetween. In this example, the electron emission regions 20 may be formed on sidewalls of the cathode electrodes 14 on the first insulation layer 16.

In addition, a second insulation layer 24 is formed on the first insulation layer 16 while covering the gate electrodes 18. A focusing electrode 22 is formed on the second insulation layer 24. That is, the gate electrodes 18 are insulated from the focusing electrode 22 by the second insulation layer 24. Openings 241 and 221, through which electron beams pass, are formed in the second insulation layer 24 and the focusing electrode 22, respectively. The openings 221 of the focusing electrode 22 may be formed to correspond to the respective pixel regions to generally converge the electrons emitted from the pixel regions. Alternatively, the openings 221 of the focusing electrode 22 may be formed to correspond to the respective openings 181 of the gate electrode 18 to individually converge the electrons emitted from each electron emission region 20. In the drawing, the former is illustrated.

In the shown embodiment, the focusing electrode 22 includes at least two focusing parts that are electrically separated from each other. The focusing parts provide focusing effects to the electron beam paths in different directions from each other to more precisely control the electron beam spot. For example, the focusing electrodes 22 include a plurality of first focusing parts 26 arranged to be in parallel with one of the cathode and gate electrodes 14 and 18 and provided with openings 221 corresponding to the respective pixel regions and a plurality of second focusing parts 28 formed between and spaced apart from the first focusing parts 26. While shown as two focusing parts 26, 28, it is understood that additional parts can be used.

Referring to the xy-plane in FIG. 1, the first focusing parts 26 are positioned at left and right sides of the electron emission regions 20. The first focusing parts 26 are electrically connected to each other to receive a first focusing voltage V1 for converging the electrons in a horizontal direction (the x-axis in FIG. 1) of the screen. The second focusing parts 28 are positioned above and below the electron emission regions 20 and electrically connected to each other to receive a second focusing voltage V2 for converging the electrons in a vertical direction (the y-axis in FIG. 1).

Phosphor layers 30 (such as the shown red, green and blue phosphor layers 30R, 30G and 30B) are formed on a surface of the second substrate 12 facing the first substrate 10. A black layer 32 for enhancing the contrast of the screen is formed on the second substrate 12 between the phosphor layers 30. The phosphor layers 30 may be formed to correspond to the respective pixel regions defined on the first substrate 10.

An anode electrode 34 formed of a conductive material (such as aluminum) is formed on the phosphor and black layers 30 and 32. The anode electrode 34 functions to heighten the screen luminance by receiving a high voltage required for accelerating the electron beams emitted via the openings 241, 221 and reflecting the visible rays radiated from the phosphor layers 30 toward the first substrate 10 back toward the second substrate 12.

Alternatively, the anode electrode 34 may be formed of a transparent conductive material (such as Indium Tin Oxide (ITO)) instead of the metallic material. In this case, the anode electrode is placed on the second substrate 12 and the phosphor and black layers 30, 32 are formed on the anode electrode 34. Alternatively, the anode electrode 34 may include a transparent conductive layer and a metallic layer.

Disposed between the first and second substrates 10 and 12 are spacers 36 (see FIG. 2) for uniformly maintaining a gap between the first and second substrates 10 and 12. The spacers 36 are disposed to correspond to the black layer 32 so as not to interfere with the light emission of the phosphor layers 30.

The above-described electron emission display is driven when a predetermined voltage is applied to the cathode electrodes 14, gate electrodes 18, first focusing parts 26, second focusing parts 28, and anode electrodes 34. For example, one of the cathode and gate electrodes 14 and 18 serves as scan electrodes receiving a scan drive voltage and the other functions as data electrodes receiving a data drive voltage. The first and second focusing parts 26 and 28 receive a negative direct current (DC) voltage of (for example, several to tens of volts) or a DC voltage of 0. The anode electrode 34 receives a positive direct current voltage (for example, hundreds through thousands of volts that can accelerate the electron beams.

Then, electric fields are formed around the electron emission regions 20 at unit pixels where a voltage difference between respective cathode and gate electrodes 14 and 18 is equal to or higher than a threshold value and thus the electrons are emitted from the electron emission regions 20. The emitted electrons are converged while passing through the openings 221 of the first focusing parts 26, and strike the corresponding phosphor layers 30 by being attracted by the high voltage applied to the anode electrode 34, thereby exciting the phosphor layers 30.

During the above-described driving operation, since the first focusing parts 26 converge the electrons in the horizontal direction of the screen while the second focusing parts 28 converge the electrons in the vertical direction of the screen, the electron beam spot reaching the corresponding phosphor layer 30 can be corrected in response to the shape of the corresponding phosphor layer 30 by properly setting the first and second focusing voltages V1 and V2.

Figure 4:
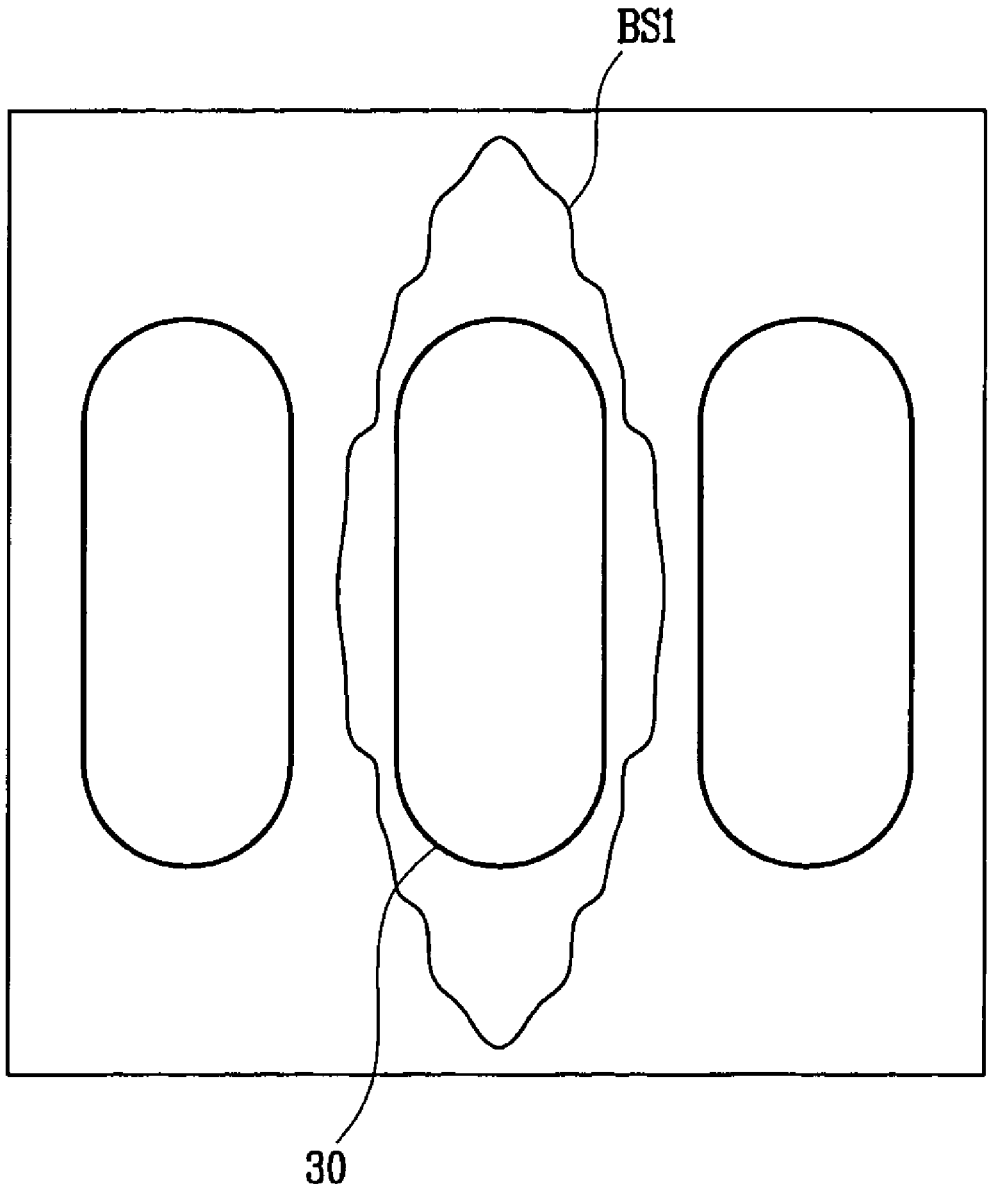
FIGS. 4 through 6 are schematic views of a phosphor layer and an electron beam spot of a conventional electron emission display.
Figure 5:
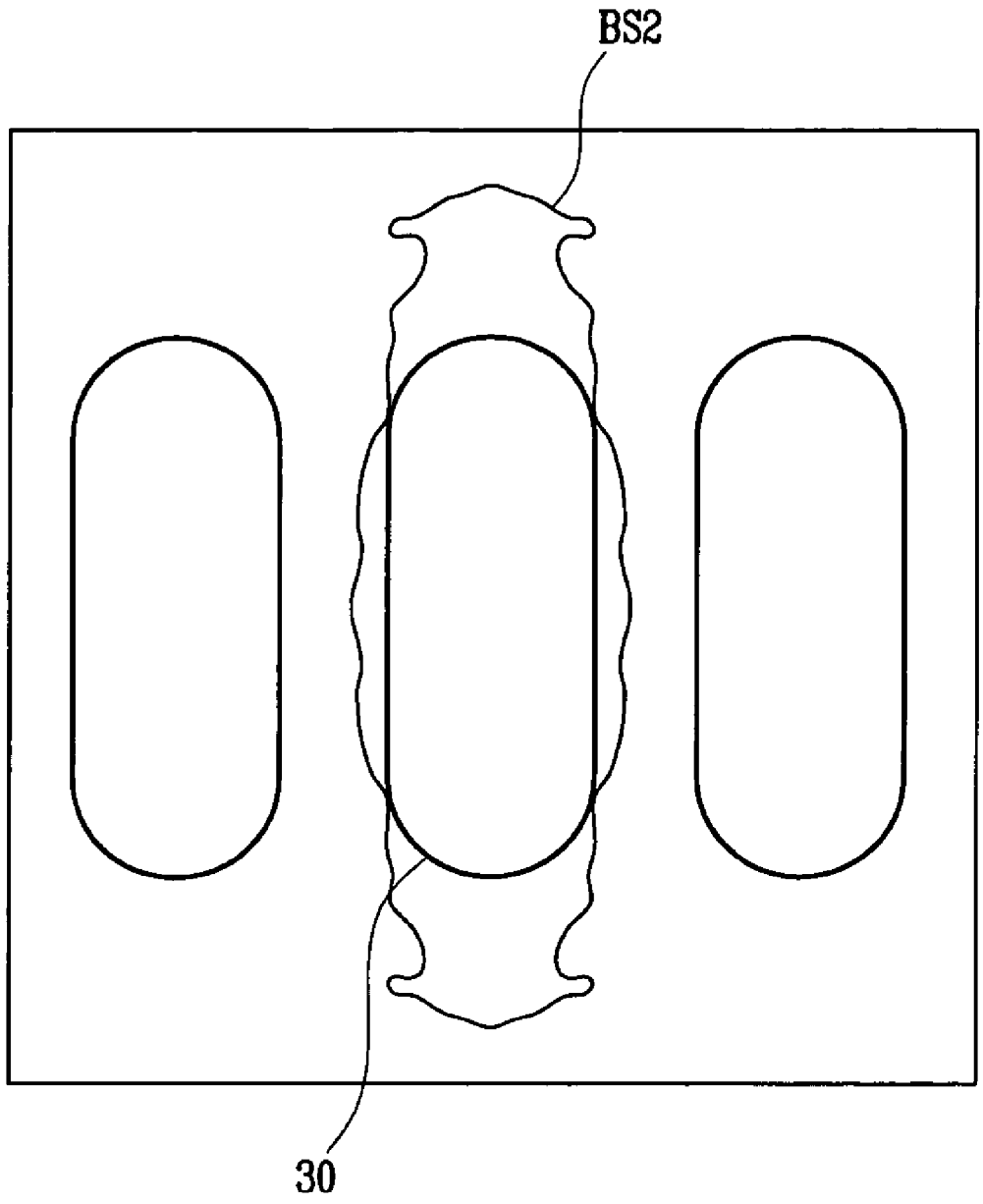
Figure 6:
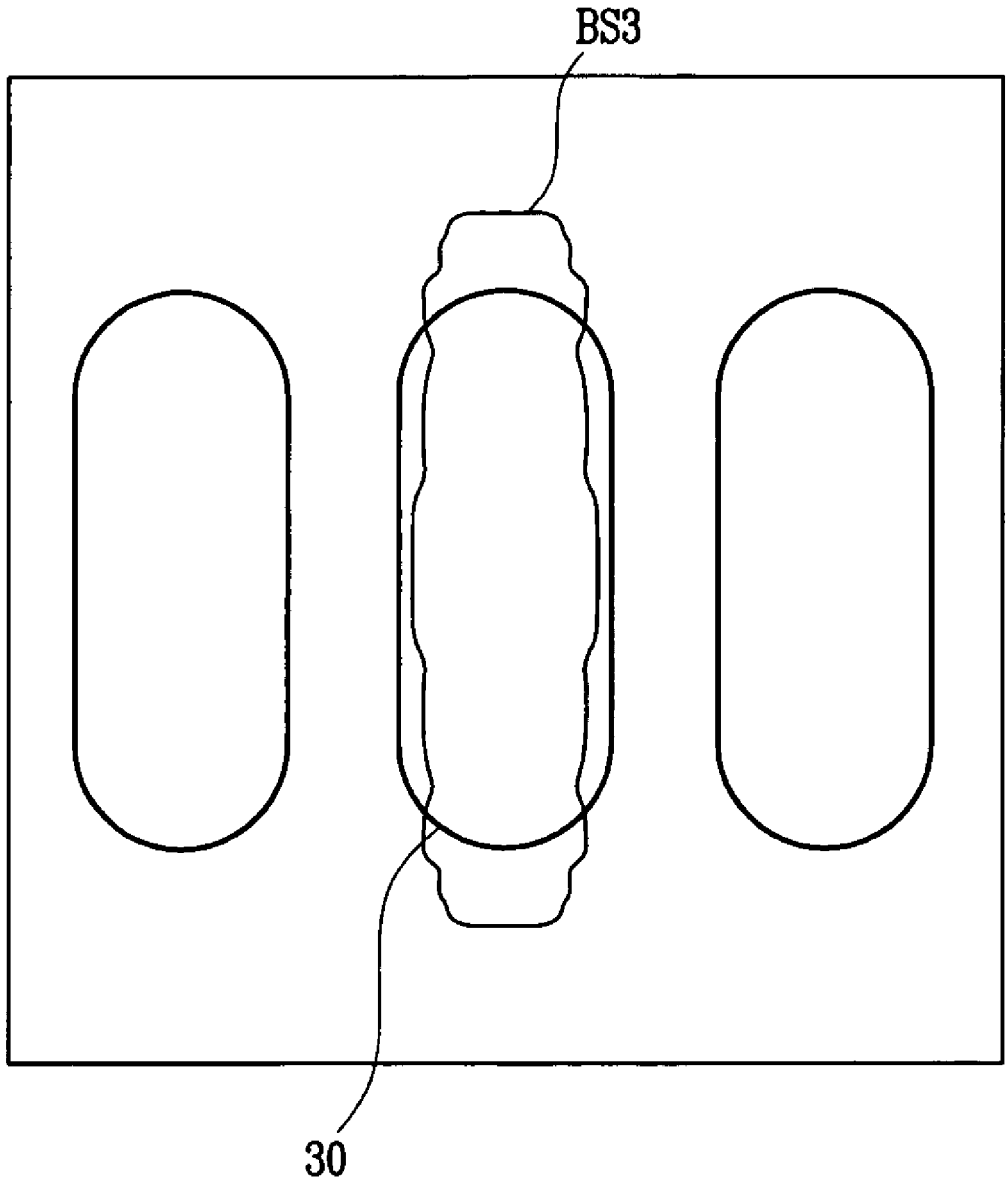

FIGS. 4 through 6 show electron beam spots each reaching the corresponding phosphor layer in the conventional electron emission display in a case where no voltage is applied to the focusing electrode (FIG. 4), a case where a voltage of −20V is applied to the focusing electrode (FIG. 5) and a case where a voltage of −50V is applied to the focusing electrode.

Referring to FIG. 4, both horizontal and vertical widths of an electron beam spot BS1 are greater than those of the phosphor layer 30 thus the light emission efficiency of the phosphor layer 30 is decreased. Referring to FIG. 5, both horizontal and vertical widths of an electron beam spot BS2 are less than those of the electron beam spot BS1 of FIG. 4 yet greater than those of the phosphor layer 30, thus decreasing the light emission efficiency of the phosphor layer 30.

Referring to FIG. 6, a horizontal width of an electron beam spot BS3 is less than that of the phosphor layer 30. Thus, there is a region where the electron beam does not land on the phosphor layer 30, thereby decreasing the light emission uniformity of the phosphor layer 30.

Figure 7:
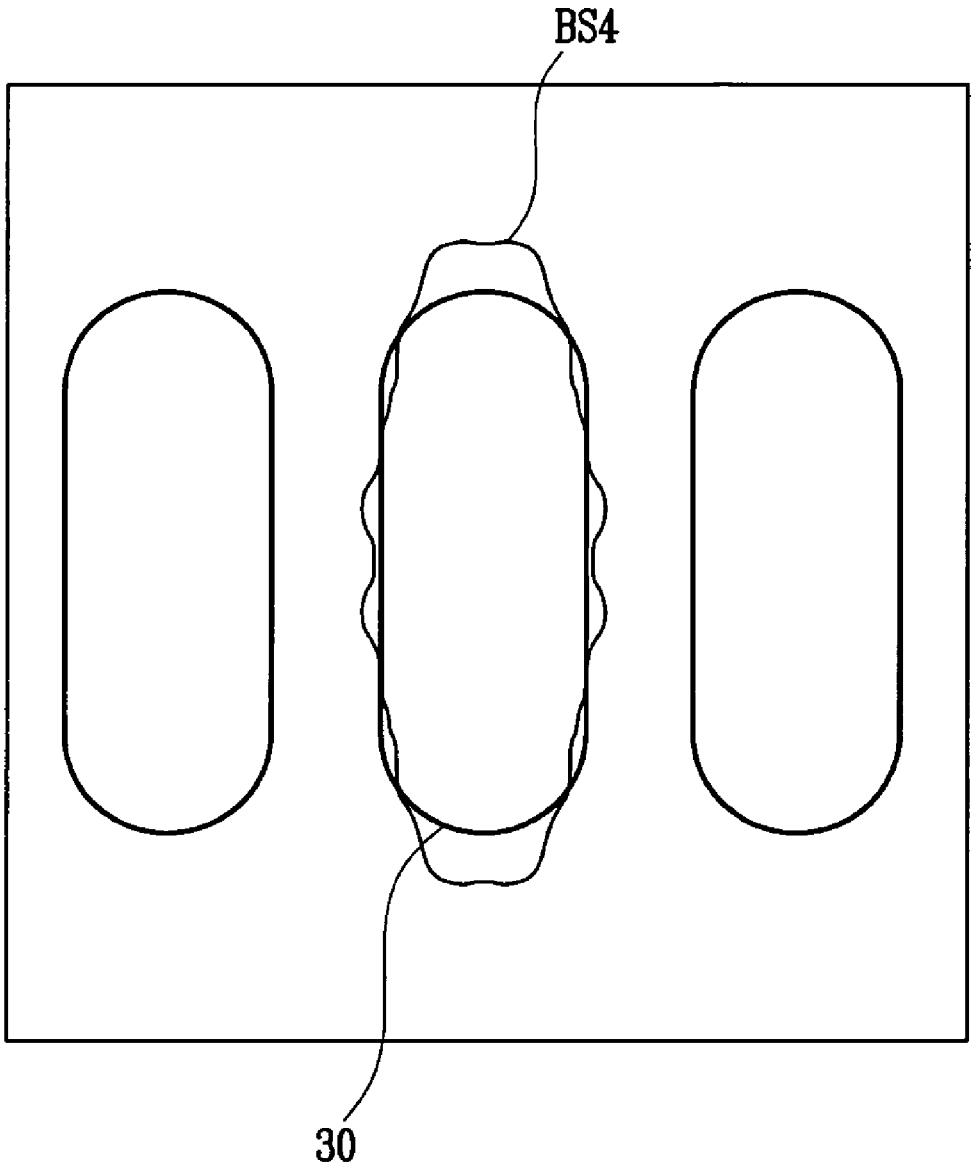
FIG. 7 is a schematic view of a phosphor layer and an electron beam spot of the electron emission display of FIGS. 1 through 3.

FIG. 7 shows electron beam spots each reaching the phosphor layer in the electron emission display of the present embodiment in a case where a voltage of −20V is applied to the first focusing parts 26 and a voltage of more than −100V is applied to the second focusing parts 28. As shown in FIG. 7, an electron beam spot BS4 has horizontal and vertical widths that are very similar to those of the phosphor layer 30 to enhance the light emission efficiency and light emission uniformity of the phosphor layer 30.

Figure 8:
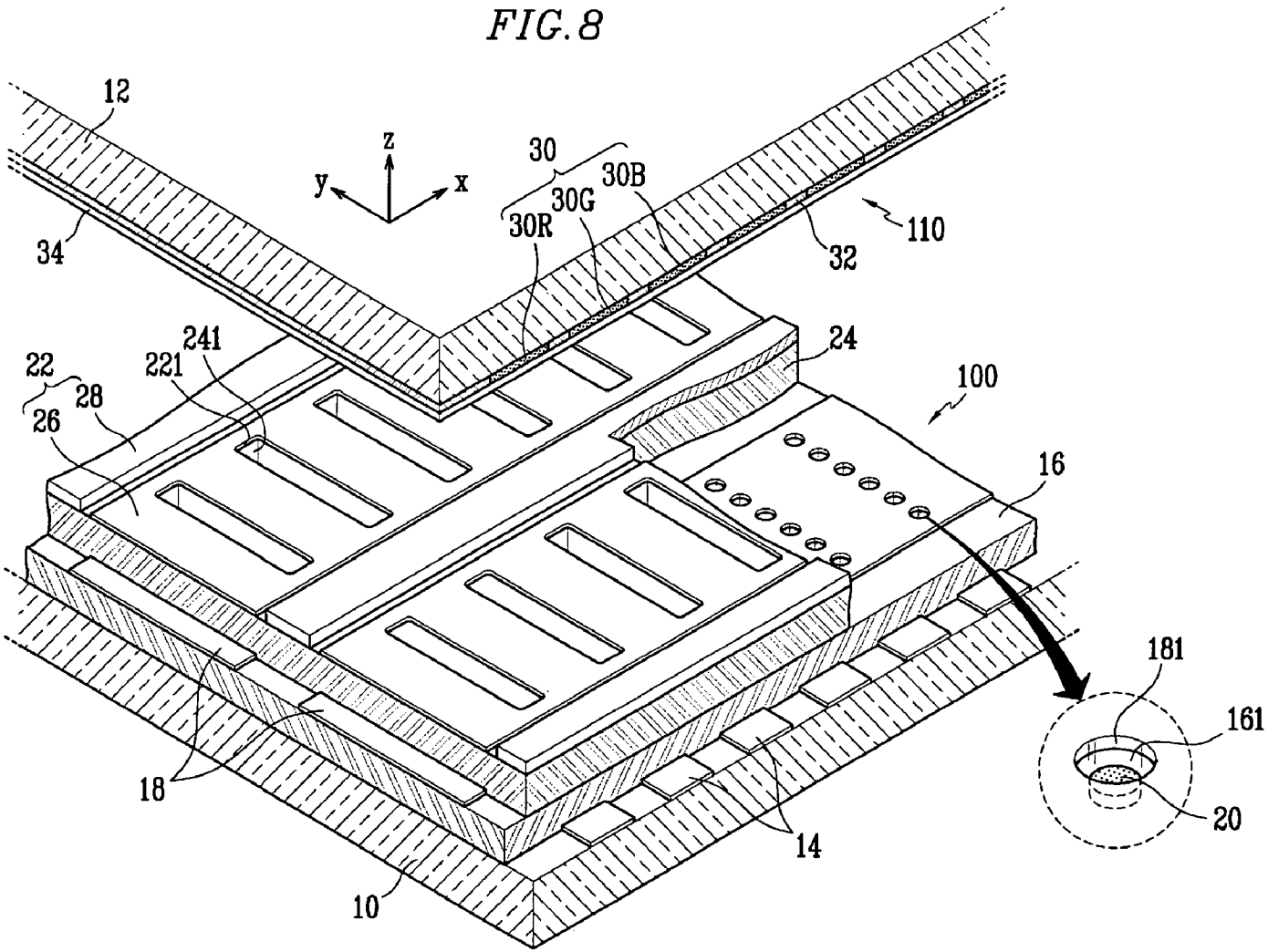
FIG. 8 is a partial exploded perspective view of an electron emission display according to another embodiment of the present invention.
Figure 9:
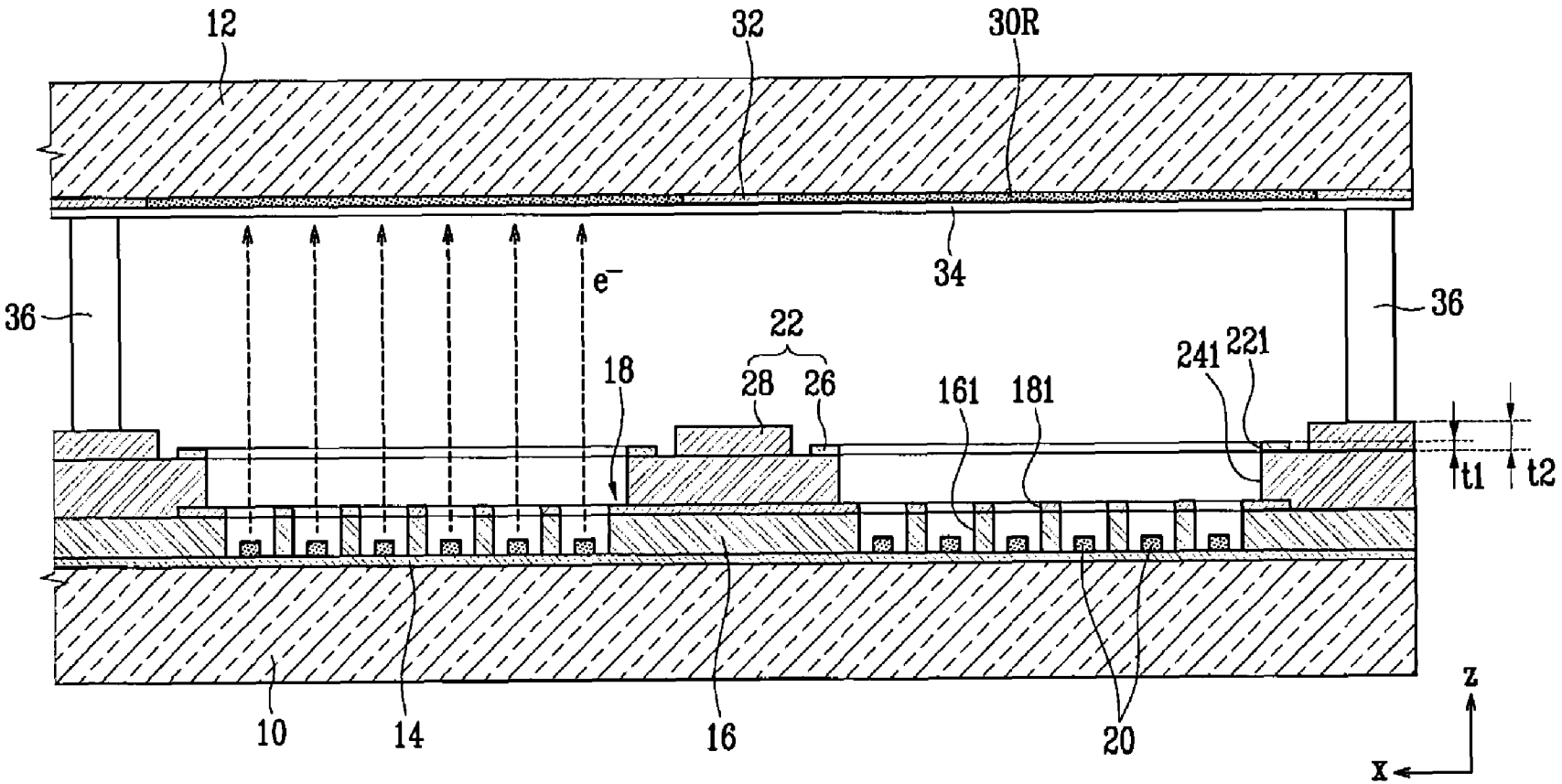
FIG. 9 is a partial sectional view of the electron emission display of FIG. 8.

FIGS. 8 and 9 show an electron emission display according to another embodiment of the present invention. For descriptive convenience, as mentioned above, like reference numerals refer to like elements in the present and forgoing embodiments. Referring to FIGS. 8 and 9, the focusing electrode 22 of this embodiment includes at least two focusing parts 26, 28 that are electrically separated from each other and different in a thickness. The focusing parts 26, 28 provide focusing effects to the electron beam paths in different directions from each other to more precisely control the electron beam spot.

For example, the focusing electrodes 22 include a plurality of first focusing parts 26 arranged to be in parallel with one of the cathode and gate electrodes 14 and 18. The first focusing parts 26 are provided with openings 221 corresponding to the respective pixel regions and a plurality of second focusing parts 28 formed between and spaced apart from the first focusing parts 26. The first and second focusing parts 26 and 28 of the shown embodiment receive voltages the same as those applied to the first and second focusing parts 26, 28 of the foregoing embodiment. Therefore, the detailed description on the application of the voltages will be omitted herein.

In the shown embodiment, in order to converge the electrons spaced apart from the focusing electrode 22 by a relatively large distance (i.e., the electrons passing through a center of the opening 221 and diffusing in the vertical direction of the screen) a thickness t2 of each second focusing part 28 is configured to be greater than that thickness t1 of the first focusing part 26. In addition, the second voltage V2 applied to the second focusing parts 28 may be greater than the first focusing voltage V1 applied to the first focusing parts 26.

When the second focusing parts 28 are formed to be higher (thicker) than the first focusing parts 26, the electron beams that could not be focused when the second focusing parts 28 were at the lower position can be focused. In addition, when the second focusing voltage V2 is higher than the first focusing voltage V1, the focusing force of the second focusing parts 28 increases and thus the electrons spaced apart from the second focusing part 28 by a relatively large distance can be effectively converged, thereby efficiently focusing the electron beam in the vertical direction of the screen.

Figure 10:
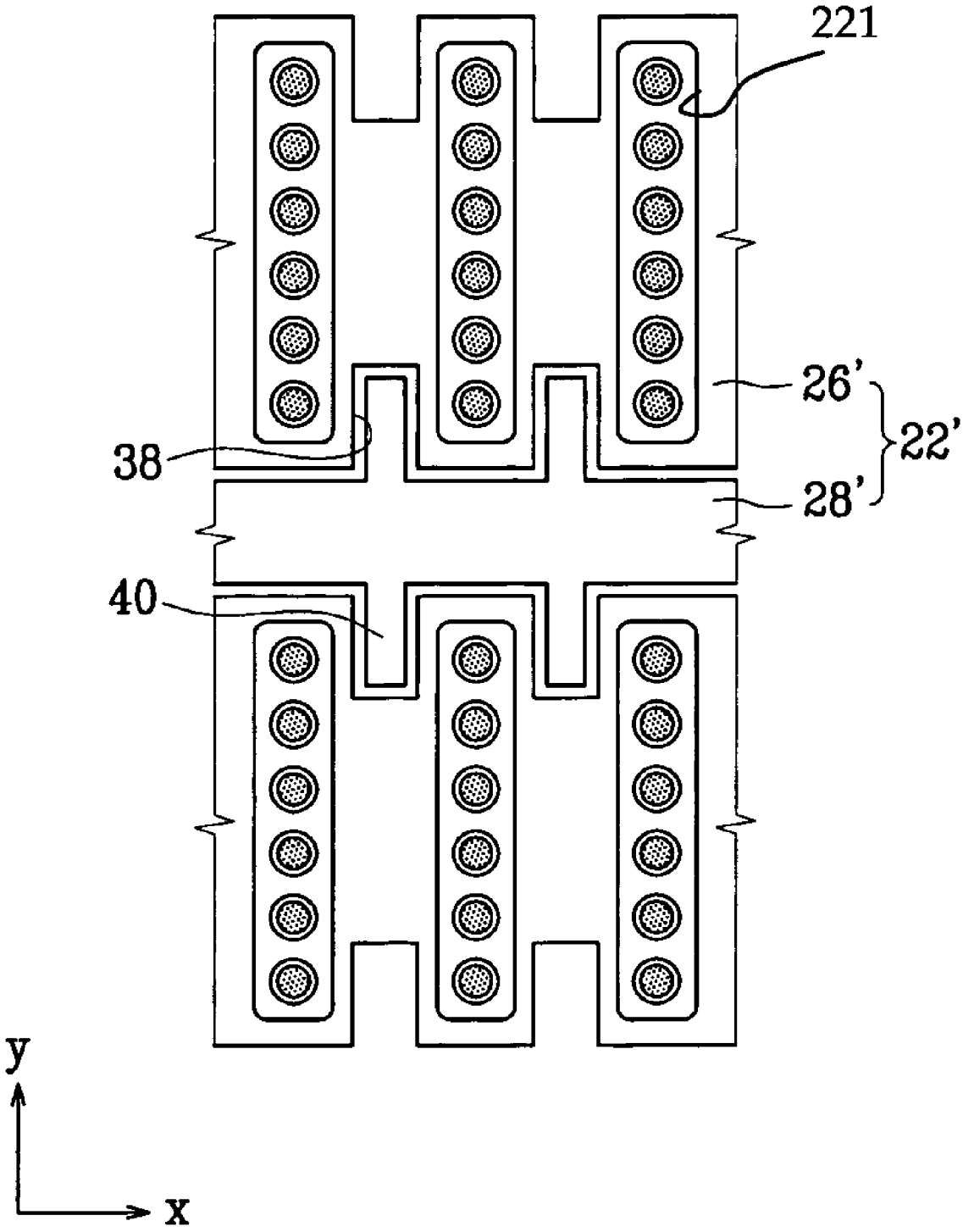
FIG. 10 is a partial top view of an electron emission device in which a modified example of a focusing electrode is illustrated.

FIG. 10 is a partial top view of an electron emission device in which a modified example of the focusing electrode 22' is illustrated. Referring to FIG. 10, indented portions 38 are formed on both sides of each first focusing part 26' between the openings 221 to partly reduce a width of the first focusing part 26'. In addition, protruding portions 40 are formed on both sides of each second focusing part 28'. The protruding portions 40 are formed to correspond to the respective indented portions 38. That is, the protruding portions 40 are disposed in the indented portions 38. Therefore, since the protruding portions 40 applied with the second focusing voltage largely surround the openings 221, the electron beam focusing efficiency in the vertical direction can be further enhanced.

Although in the foregoing embodiments, where aspects of the present invention are applied to the electron emission device having an array of FEA elements are illustrated, aspects of the present invention can also be applied to an electron emission device having an array of Surface Conduction Emitter (SCE) elements, Metal-Insulator-Metal (MIM) elements or Metal-Insulator-Semiconductor (MIS) elements.

According to aspects of the present invention, since the focusing electrode includes at least two focusing parts electrically separated from each other and the focusing parts focus the electron beams in different directions, electron beam spots have horizontal and vertical widths that are very similar to those of respective phosphor layers. Therefore, the light emission efficiency, the luminance and light emission uniformity of the electron emission display can be enhanced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An electron emission device, comprising:

a substrate;

a plurality of electron emission regions formed on the substrate;

a plurality of driving electrodes formed on the substrate to control electron emissions of the electron emission regions; and a focusing electrode disposed above the driving electrodes and insulated from the driving electrodes, the focusing electrode having openings through which electron beams pass, wherein the focusing electrode comprises at least two focusing parts electrically separated from each other and wherein, with respect to each opening, the focusing parts are positioned to focus the electron beams passing though the opening in different directions.

2. The electron emission device of claim 1, wherein the focusing parts comprise first focusing parts arranged in a direction of the first substrate and provided with the openings, and second focusing parts disposed between the first focusing parts and spaced apart from the first focusing parts.

3. The electron emission device of claim 2, wherein a longitudinal distance of each of the openings is formed along a width of the first focusing part.

4. The electron emission device of claim 1, wherein the focusing parts are disposed at different distances above the driving electrodes.

5. The electron emission device of claim 1, wherein the focusing parts have different corresponding thicknesses.

6. The electron emission device of claim 5, wherein the focusing parts comprise first focusing parts arranged in a direction of the first substrate and provided with the openings and second focusing parts disposed between the first focusing parts and spaced apart from the first focusing parts.

7. The electron emission device of claim 6, wherein a longitudinal distance of each of the openings is formed along a width of the first focusing part.

8. The electron emission device of claim 7, wherein a thickness of the second focusing part is greater than that of the first focusing part.

9. The electron emission device of claim 2, wherein each first focusing part includes an indented portion formed on both sides of each first focusing part between adjacent pairs of the openings, each second focusing part includes protruding portions on opposing sides of the second focusing parts and the protruding portions are formed to correspond to the respective indented portions such that the protruding portions are disposed in the indented portions.

10. The electron emission device of claim 1, wherein the driving electrodes comprise cathode electrodes and gate electrodes crossing each other at crossed regions and disposed at different layers, the electron emission device further comprises an insulation layer interposed between the layers and the electron emission regions are formed on the cathode electrodes at each of the crossed regions of the cathode and gate electrodes.

11. The electron emission device of claim 1, wherein the electron emission regions are arranged in a line along a length of one of the cathode and gate electrodes at each crossed region where the cathode electrode crosses the gate electrode.

12. The electron emission device of claim 10, wherein the focusing electrode is provided with openings, which correspond to the respective crossed regions to simultaneously expose the electron emission regions formed at each crossed region.

13. The electron emission device of claim 10, wherein each electron emission region is formed of carbon nanotubes, graphite, graphite nanofibers, diamonds, diamond-like carbon, fullerene ($C_{60}$), silicon nanowires, or a combination thereof.

14. The electron emission device of claim 1, wherein the electron emission device is one of Field Emitter Array (FEA) elements, Surface Conduction Emitter (SCE) elements, Metal-Insulator-Metal (MIM) elements, and Metal-Insulator-Semiconductor (MIS) elements.

15. An electron emission display, comprising:

first and second substrates facing each other;

a plurality of electron emission regions formed on the first substrate;

a plurality of driving electrodes formed on the first substrate to control electron emissions of the electron emission regions;

a focusing electrode disposed above the driving electrodes and insulated from the driving electrodes, the focusing electrode having openings through which electron beams pass;

red, green and blue phosphor layers formed on the second substrate; and an anode electrode formed on the phosphor layers, wherein the focusing electrode comprises at least two focusing parts electrically separated from each other and wherein, with respect to each opening, the focusing parts are positioned to focus the electron beams passing though the opening in different directions to reach the red, green and blue phosphor layers.

16. The electron emission display of claim 15, wherein the openings of the focusing electrode correspond to respective pixel regions of the first substrate and the phosphor layers correspond to the respective pixel regions.

17. An electron emission device, comprising:

a substrate;

a plurality of electron emission regions formed on the substrate;

a plurality of driving electrodes formed on the substrate to control electron emissions of the electron emission regions; and a focusing electrode disposed above the driving electrodes and insulated from the driving electrodes, the focusing electrode having openings through which electron beams pass, wherein the focusing electrode comprises at least two focusing parts electrically separated from each other and wherein with respect to each opening, the focusing parts form respective electric fields to focus the electron beams passing through the opening, the electric fields being different from each other.

18. The electron emission device of claim 17, wherein the focusing parts comprise first focusing parts arranged in a direction of the first substrate and provided with the openings and second focusing parts disposed between the first focusing parts and spaced apart from the first focusing parts.

19. The electron emission device of claim 18, wherein the first focusing parts are electrically connected to each other to form a first common electric field and the second focusing parts are electrically connected to each other to form a second common electric field.

20. The electron emission device of claim 19, wherein a longitudinal distance of each of the openings is formed along a width of the first focusing part.

21. The electron emission device of claim 17, wherein the focusing parts are disposed at different distances above the driving electrodes.

22. The electron emission device of claim 17, wherein the focusing parts have different corresponding thicknesses.

23. The electron emission device of claim 22, wherein the focusing parts comprise first focusing parts arranged in a direction of the first substrate and provided with the openings and second focusing parts disposed between the first focusing parts and spaced apart from the first focusing parts.

24. The electron emission device of claim 23, wherein a longitudinal distance of each of the openings is formed along a width of the first focusing part.

25. The electron emission device of claim 24, wherein a voltage applied to the first focusing parts is less than that applied to the second focusing parts.

26. The electron emission device of claim 18, wherein each first focusing includes an indented portion formed on both sides of each first focusing part between adjacent pairs of the openings, each second focusing part includes protruding portions on opposing sides of the second focusing parts and the protruding portions are formed to correspond to the respective indented portions such that the protruding portions are disposed in the indented portions.

27. The electron emission device of claim 17, wherein the driving electrodes comprise cathode electrodes and gate electrodes crossing each other at crossed regions and disposed at different layers, with the electron emission device further comprises an insulation layer interposed between the layers and the electron emission regions are formed on the cathode electrodes at each of the crossed regions of the cathode and gate electrodes.

28. The electron emission device of claim 27, wherein the electron emission regions are arranged in a line along a length of one of the cathode and gate electrodes at each crossed region where the cathode electrode crosses the gate electrode.

29. The electron emission device of claim 27, wherein the focusing electrode is provided with openings, which correspond to the respective crossed regions to simultaneously expose the electron emission regions formed at each crossed region.

30. The electron emission device of claim 27, wherein each electron emission region is formed of carbon nanotubes, graphite, graphite nanofibers, diamonds, diamond-like carbon, fullerene ($C_{60}$), silicon nanowires, or a combination thereof.

31. The electron emission device of claim 17, wherein the electron emission device is one of Field Emitter Array (FEA) elements, Surface Conduction Emitter (SCE) elements, Metal-Insulator-Metal (MIM) elements, and Metal-Insulator-Semiconductor (MIS) elements.

32. An electron emission display, comprising:

first and second substrates facing each other;

a plurality of electron emission regions formed on the first substrate;

a plurality of driving electrodes formed on the substrate to control electron emissions of the electron emission regions;

a focusing electrode disposed above the driving electrodes and insulated from the driving electrodes, the focusing electrode having openings through which electron beams pass;

red, green and blue phosphor layers formed on the second substrate; and an anode electrode formed on the phosphor layers, wherein the focusing electrode comprises at least two focusing parts electrically separated from each other and wherein with respect to each opening, the focusing parts form respective electric fields to focus the electron beams passing through the opening to reach the corresponding red, green and blue phosphor layers, the electric fields being different from each other.

33. The electron emission display of claim 32, wherein the openings of the focusing electrode correspond to respective pixel regions of the first substrate and the phosphor layers correspond to the respective pixel regions.

34. An electron emission device, comprising:

a substrate to support the electron emission device;

a plurality of electron emission regions formed on the substrate to emit a plurality of electron beams;

a plurality of driving electrodes formed on the substrate to control emission of the electron beams from the electron emission regions; and a focusing electrode disposed above and insulated from the driving electrodes, the focusing electrode comprising:

an opening through which the electron beams pass;

a first focusing part to focus the electron beams in a first direction of a plane, and a second focusing part electrically separated from the first focusing part to focus the electron beams in a second direction of the plane.

35. An electron emission display, comprising:

the electron emission device of claim 34;

another substrate facing the substrate, wherein a vacuum space is formed between the substrate and the another substrate;

red, green and blue phosphor layers formed on the another substrate to emit light when irradiated by the electron beams; and an anode electrode formed on the phosphor layers to accelerate the electron beams.

* * * * *